United States Patent [19]

Hansen

[11] Patent Number: 4,705,485

[45] Date of Patent: Nov. 10, 1987

[54] ELECTRICAL JACK-PLUG

[76] Inventor: Jørgen Hansen, No. 44 Webersgade, DK-2100 Copenhagen Ø, Denmark

[21] Appl. No.: 796,617

[22] PCT Filed: Feb. 27, 1985

[86] PCT No.: PCT/DK85/00019

§ 371 Date: Oct. 9, 1985

§ 102(e) Date: Oct. 9, 1985

[87] PCT Pub. No.: WO85/04053

PCT Pub. Date: Sep. 12, 1985

[30] Foreign Application Priority Data

Feb. 28, 1984 [DK] Denmark ..... 1186/84

[51] Int. Cl.[4] ..... H01R 17/18

[52] U.S. Cl. ..... 439/669; 439/695

[58] Field of Search ..... 339/182, 183, 177 R, 339/177 E

[56] References Cited

U.S. PATENT DOCUMENTS

| | | | |
|---|---|---|---|
| 1,222,585 | 4/1917 | Carlson | 339/183 |
| 1,950,215 | 3/1964 | Baum | 339/183 |
| 2,703,393 | 3/1955 | Bird | 339/183 |
| 3,246,282 | 4/1966 | Mas et al. | 339/183 |
| 3,546,657 | 12/1970 | Cook | 339/182 R |
| 3,649,948 | 3/1972 | Porter | 339/183 |

FOREIGN PATENT DOCUMENTS

| | | | |
|---|---|---|---|
| 2323612 | 11/1974 | Fed. Rep. of Germany . | |
| 2743406 | 5/1978 | Fed. Rep. of Germany | 339/182 R |
| 315030 | 7/1968 | Sweden . | |
| 578576 | 7/1946 | United Kingdom . | |
| 805728 | 12/1958 | United Kingdom | 339/182 R |
| 974786 | 12/1964 | United Kingdom . | |

*Primary Examiner*—Neil Abrams
*Assistant Examiner*—David Pirlot
*Attorney, Agent, or Firm*—Browdy and Neimark

[57] ABSTRACT

An electrical jack-type connector, mainly for low voltage purposes, having a rod-shaped male part having terminals in the form of conducting, axially displaced contact rings, and a matching tubular female part having axially and peripherially displaced inner terminals to make contact with the contact rings of the male part, with the female part having an outer tube and an inner tube fitted therein, which inner tube is formed with rectangular slots for arrangement of the terminals of the female part, in each slot there being a flat substantially rectangular contact flap connected with a respective conductor located between the inner tube and outer tube in a narrow track extending on the tube wall parallel to the tube axis from the slot to an orifice at one end of the inner tube for connection with cable conductors within a closed end. The contact flaps are strip-formed rectangular pieces extending beyond the length of the slots so as to be forced to assume a curvature upon insertion of the inner tube into the outer tube.

3 Claims, 5 Drawing Figures

ELECTRICAL JACK-PLUG

The invention relates to an electrical jack-type connector, mainly for low voltage purposes, comprising a rod-shaped male part having terminals in the form of conducting, axially displaced contact rings and a matching tubular female part having axially and peripherally displaced inner terminals to form contact with the contact rings of the male part, which female part comprises an outer tube and an inner tube fitted therein, which is formed with slots for the arrangement of the terminals of the female part, each in connection with a respective conductor located between the inner tube and the outer tube for connection with cable conductors within a closed end of the outer tube.

Electrical connectors of this kind are known from U.S. patent specifications Nos. 1,222,585 and 2,703,393, the former of which shows an embodiment in which the female part has ball-shaped terminals in connection with contact springs placed in an annular space between the outer tube and the inner tube, whereas the terminals in the latter patent specification are bent contact springs mounted in slits in a special tubular body.

These known designs have a fairly complicated structure, and in both cases the terminals of the female part take up quite a lot of space such that the connectors in question are difficult to construct in small dimensions and are not suitable for uses in which the male and female parts are to have a comparatively large number of terminals. Moreover, the establishment of a safe contact in the known connectors presupposes a comparatively great pressure action of the contact springs, whereby the operation of the connector may be rendered difficult.

The invention has for its object to provide an improved design of an electrical connector of the kind mentioned, having a very simple construction, comprising a small number of separate parts and having great reliability as regards function and being easy to operate.

In order to achieve this, the connector according to the invention is characterized in that the inner tube is formed for tight insertion into the outer tube and has mainly rectangular slots, each being connected on the external side of the inner tube with a comparatively narrow track extending parallel to the tube axis from the slot to an orifice at one end of the inner tube, and that the terminals of the female part comprise short strip-shaped contact flaps, each in connection with its respective conductor and formed for loose arrangement into its respective slot and the associated track prior to the insertion of the inner tube into the outer tube, the conductors being of such length as to, on the insertion of the inner tube into the outer tube, be led through an aperture at one end of the outer tube, which aperture is close.d by a cap after connection of the supply lines with said cable conductors.

Since the female part comprises only a few separate components, viz. outer tube, inner tube, contact flaps with conductors and possibly a final cap, of which the two tubes and the cap can be made by moulding from a suitable plastic material, and since the contact flaps with conductors are loosely mounted in the slots and tracks of the inner tube so as to avoid fastening operations, the manufacturing costs can be kept very low both in the processing and assembling of the separate components.

Moreover, the hermetically sealed confinement of the connectors of the contact flaps resulting from the tight fitting of the inner tube into the outer tube provides a particularly good protection of the electrically conducting components against mechanical and other influences from the environment.

When the contact flaps are mounted in the slots of the inner tube, the flaps will form cords in the inner tube's circular cross section, thus forming good contact at comparatively modest spring pressure.

Owing to its simple operation, the connector according to the invention is especially suitable for watertight implementation for use in connection with underwater communication equipment and the like, since the connection between the male and female parts can be made watertight without difficulty, and the outer tube in the cable entry end can be closed by a watertight mounted cap.

The invention is explained below in closer detail by means of an embodiment shown on the drawing, in which FIGS. 1 and 2 are perspective views of male and female part, respectively, in a watertight connector according to the invention, seen from the outside;

Figure 1:
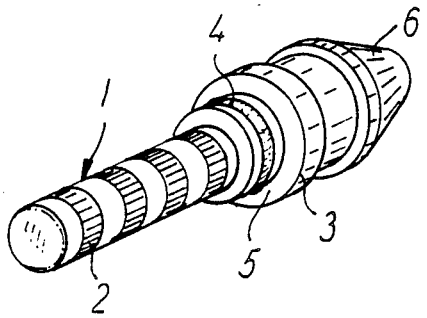

The jack-type male part shown in FIG. 1 has a circular-cylindrical rod-shaped body 1 formed for insertion into the tubular female part, said body having terminals in the form of axially displaced contact rings 2. In front of an abutment 3 formed to rest against the end of the female part, a sealing ring 5 is fitted in a groove 4 for watertight closing in the linking of male and female part.

At the end, the male part 1 finishes with a watertight mounted cap 6 which protects the soldering joints between not shown encapsulated conductors for the contact rings 2 and conductors in a cable connected with the male part 1.

Figure 2:
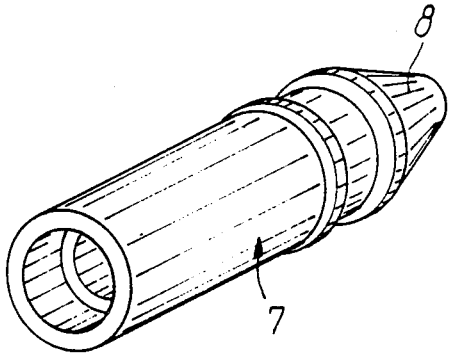

FIG. 2 shows the female part seen from the outside and ending with a watertight mounted cap 8 in the same way as the male part 1.

Figure 3:
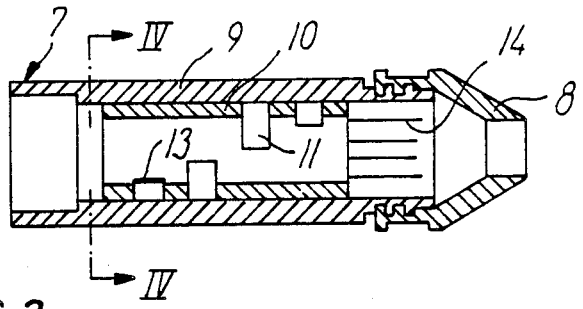
FIG. 3 is a longitudinal section of the female part.

As shown in FIG. 3, the female part 7 comprises an outer tube 9 and an inner tube 10 tightly fitted within the outer tube. A number of axially and peripherally displaced, mainly rectangular, slots 11 are formed in the inner tube 10, as is more clearly shown in FIG. 5. Each of these slots 11 is connected at one of its lateral edges parallel to the tube axis on the external side of the inner tube 10 with a track 12 extending from the slot 11 in question and opening into the end of the inner tube 10 which is to be placed against the bottom of the outer tube 9.

Figure 4:
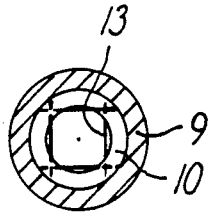
FIG. 4 is a cross section at the line IV—IV in FIG. 3.
Figure 5:
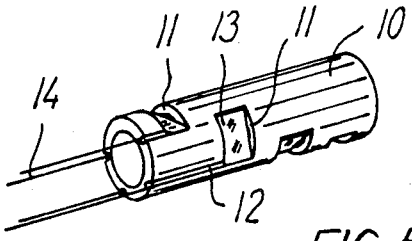
FIG. 5 is a perspective view of the inner tube and contact members of the female part.

As also shown in FIG. 5, the terminals of the female part are formed as short, planar strip-shaped contact flaps 13 to be arranged in their respective rectangular slots 11 and having such length as to rest on the lateral edges of the slot 11 parallel to the tube axis, whereby each contact flap 13 on being placed in a slot 11 in projection to the circular cross section of the inner tube 10 will extend as a cord when viewed, as can be seem in FIG. 4, and will be retained in this position on the fitting of the inner tube 10 into the outer tube 9, in that the internal wall of the outer tube 9 presses against the end edges of the flap 13.

Each contact flap 13 has at one edge a thread- or strip-shaped conductor 14 which can be punched together with the contact flap and which on arrangement of the flap 13 in a slot 11 will be placed in the associated track 12 parallel to the tube axis on the external side of the inner tube 10.

As shown in FIG. 5, the conductors 14 have each such length as to project beyond the above mentioned end of the inner tube 10 so that when the latter is placed in the outer tube 9, they are led through an opening formed at the end of the outer tube 9.

Before the final attachment of the watertight cap 8, the conductors 14 are connected with not shown cable conductors in the same way as the conductors in the male part 1.

I claim:

1. An electrical jack-type connector, mainly for low voltage purposes, comprising a rod-shaped male part (1) having terminals in the form of conducting, axially displaced contact rings (2) and a matching tubular female part (7) having axially and peripherally displaced inner teminals to form contact with the contact rings (2) of the male part, which female part (7) comprises an outer tube (9) and an inner tube (10) fitted therein, which is formed with slots for the arrangement of the terminals of the female part (7), each being in connection with a respective conductor located between the inner tube (10) and the outer tube (9) for connection with cable conductors within a closed end of the outer tube (10), characterized in that the inner tube (10) is formed for tight insertion into the outer tube (9) and has substantially rectangular slots (11) formed in its tube wall, each of said slots communicating with a comparatively narrow track (12) extending on the external side of said tube wall parallel to the tube axis from the slot to an orifice at one end of the inner tube (10), and that the terminals of the female part comprise contact flaps (13), each formed of a single flat rectangular planar surface having opposed edges abutting the inner wall of the outer tube each formed integrally with its respective conductor (14) for loose arrangement into its respective slot and the track (12) communicating therewith prior to the insertion of the inner tube (10) into the outer tube (9), the conductors being of such length as to, on the insertion of the inner tube (10) into the outer tube (9), be led through an aperture at one end of the outer tube (9), which aperture is closed by a cap (8) after connection of said respective conductors (14) with the cable conductors.

2. A female connector part for an electrical jack-type connector, mainly for low voltage purposes, for receiving in matching relationship a rod-shaped male connector part (1) having terminals in the form of conducting, axially displaced contact rings (2), said female connector part (7) having axially and peripherally displaced inner terminals to form contact with the contact rings (2) of the male part and comprising an outer tube (9) and an inner tube (10) fitted therein, which is formed with slots for the arrangement of the terminals of the female part (7), each being in connection with a respective conductor located between the inner tube (10) and the outer tube (9) for connection with cable conductors within a closed end of the outer tube (10), characterized in that the inner tube (10) is formed for tight insertion into the outer tube (9) and has substantially rectangular slots (11) formed in its tube wall, each of said slots communicating with a comparatively narrow track (12) extending on the external side of said tube wall parallel to the tube axis from the slot to an orifice at one end of the inner tube (10), andd that the terminals of the female part comprise contact flaps (13), each formed of a single flat rectangular planar surface having opposed edges abutting the inner wall of the outer tube, each formed integrally with its respective conductor (14) loose arrangement into its respective slot and the track (12) communicating therewith prior to the insertion of the inner tube (10) into the outer tube (9), the conductors being of such length as to, on the insertion of the inner tube (10) into the outer tube (9), be led through an aperture at one end of the outer tube (9), which aperture is closed by a cap (8) after connection of said respective conductors (14) with the cable conductors.

3. The female connector part of claim 2 wherein said contact flaps (13) extend as chords of the inner wall of said outer tube (9) with opposed edges of flaps (13) pressed by the inner wall of outer tube (9).

* * * * *